US010393099B2

(12) United States Patent
Yatsu

(10) Patent No.: US 10,393,099 B2
(45) Date of Patent: Aug. 27, 2019

(54) CRYOPUMP SYSTEM, CRYOPUMP CONTROLLER, AND CRYOPUMP REGENERATION METHOD

(71) Applicant: SUMITOMO HEAVY INDUSTRIES, LTD., Tokyo (JP)

(72) Inventor: Takahiro Yatsu, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 228 days.

(21) Appl. No.: 15/043,507

(22) Filed: Feb. 13, 2016

(65) Prior Publication Data

US 2016/0245270 A1 Aug. 25, 2016

(30) Foreign Application Priority Data

Feb. 20, 2015 (JP) ..... 2015-031852

(51) Int. Cl.
*F04B 37/08* (2006.01)
*F04B 41/00* (2006.01)
*F04B 49/06* (2006.01)

(52) U.S. Cl.
CPC ..... *F04B 37/085* (2013.01); *F04B 37/08* (2013.01); *F04B 41/00* (2013.01); *F04B 49/065* (2013.01); *F04B 2205/00* (2013.01)

(58) Field of Classification Search
CPC ..... F04B 37/08; F04B 37/085; Y10S 417/901
See application file for complete search history.

(56) References Cited

U.S. PATENT DOCUMENTS 5,971,711 A * 10/1999 Noji ..... F04B 37/08 417/2
6,022,195 A * 2/2000 Gaudet ..... F04B 37/08 417/27
6,510,697 B2 * 1/2003 Buonpane ..... F04B 37/08 417/901
2001/0012485 A1 * 8/2001 Gaudet ..... F04B 37/08 417/53
2012/0285182 A1 * 11/2012 Ando ..... F04B 37/08 62/55.5

FOREIGN PATENT DOCUMENTS

JP 07-208332 A 8/1995
JP 2008-223538 A 9/2008

* cited by examiner

*Primary Examiner* — Keith M Raymond
(74) *Attorney, Agent, or Firm* — HEA Law PLLC

(57) ABSTRACT

A cryopump system includes a cryopump, and a regeneration control unit that controls the cryopump according to a regeneration sequence including a discharge process of rough pumping the cryopump to discharge condensate from it. The regeneration control unit includes a pressure drop rate computation unit that computes a pressure drop rate for the cryopump during the rough pumping of the cryopump, and a pressure drop rate monitoring unit that detects diminishment in the pressure drop rate during the rough pumping.

8 Claims, 4 Drawing Sheets

CRYOPUMP SYSTEM, CRYOPUMP CONTROLLER, AND CRYOPUMP REGENERATION METHOD

RELATED APPLICATIONS

Priority is claimed to Japanese Patent Application No. 2015-031852, filed Feb. 20, 2015, the entire content of which is incorporated herein by reference.

BACKGROUND

Technical Field

Certain embodiments of the invention relate to a cryopump system, a cryopump controller, and a cryopump regeneration method.

Description of Related Art

A cryopump is a vacuum pump that traps and exhausts gas molecules by means of condensation or adsorption onto a cryogenically chilled cryopanel. Cryopumps are generally employed in order to realize the clean vacuum environments demanded in processes associated with semiconductor-circuit manufacturing. Since cryopumps are so-called entrapment vacuum pumps, they require regeneration whereby the trapped gases are periodically discharged to the exterior.

SUMMARY

One embodiment of the present invention affords a cryopump system including: a cryopump; and a regeneration control unit that controls the cryopump according to a regeneration sequence including a discharge process whereby rough pumping of the cryopump is performed, the discharge process discharging condensate from the cryopump. The regeneration control unit includes a pressure drop rate computation unit that computes a pressure drop rate for the cryopump during the rough pumping of the cryopump, and a pressure drop rate monitoring unit that detects diminishment in the pressure drop rate during the rough pumping.

Another embodiment of the present invention affords a cryopump controller including a regeneration control unit that controls the cryopump according to a regeneration sequence including a discharge process whereby rough pumping of the cryopump is performed, the discharge process discharging condensate from the cryopump. The regeneration control unit includes a pressure drop rate computation unit that computes a pressure drop rate for the cryopump during the rough pumping of the cryopump, and a pressure drop rate monitoring unit that detects diminishment in the pressure drop rate during the rough pumping.

Still another embodiment of the present invention affords a cryopump regeneration method including controlling a cryopump according to a regeneration sequence including a discharge process whereby rough pumping of the cryopump is performed, the discharge process discharging condensate from the cryopump. The controlling includes computing a pressure drop rate for the cryopump during the rough pumping of the cryopump, and detecting diminishment in the pressure drop rate during the rough pumping.

DETAILED DESCRIPTION

Figure 1:
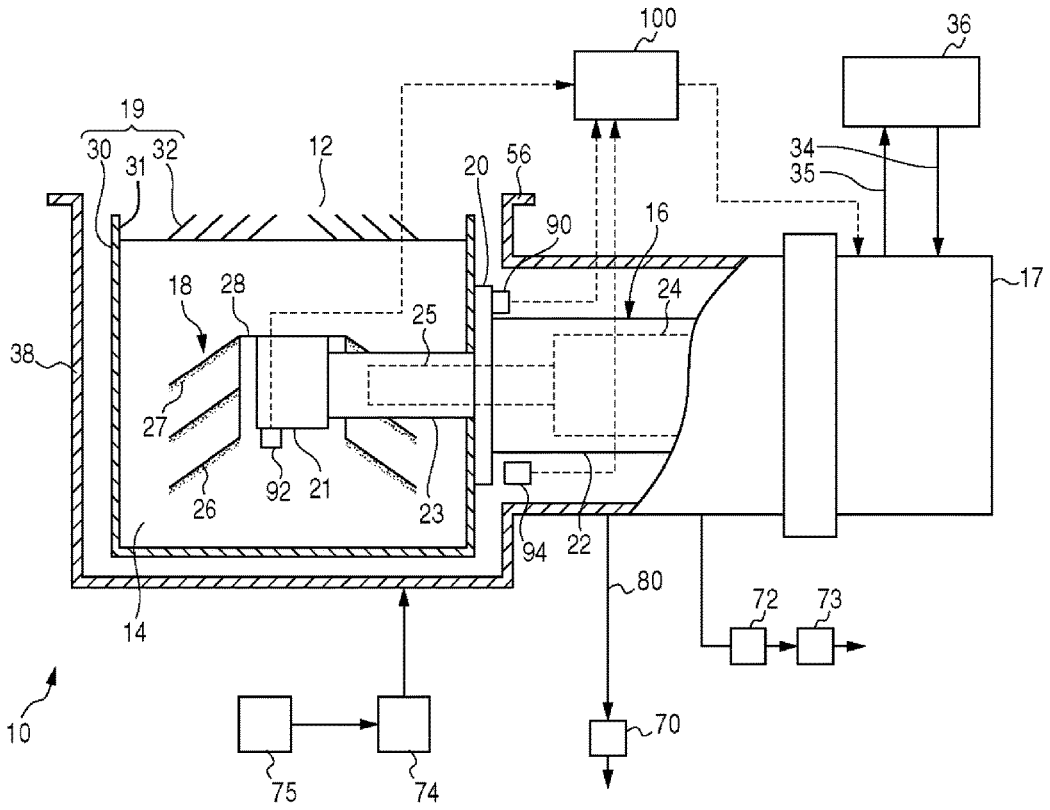
FIG. 1 is a diagram schematically showing a cryopump system according to an embodiment of the present invention.

It is desirable to shorten a regeneration time of a cryopump.

In addition, aspects of certain embodiments of the invention include arbitrary combinations of the above-described components, or components or representations of certain embodiments of the invention which are replaced by each other among a device, a method, a system, a computer program, a recording medium storing a computer program, or the like.

According to certain embodiments of the invention, it is possible to shorten a regeneration time of a cryopump.

Hereinafter, embodiments of the invention will be described in detail with reference to the drawings. In addition, in descriptions thereof, the same reference numerals are assigned to the same elements, and overlapping descriptions are appropriately omitted. Moreover, configurations described below are only examples, and ranges of certain embodiments of the invention are not limited by the configurations.

FIG. 1 is a diagram schematically showing a cryopump system according to an embodiment of the present invention. The cryopump includes a cryopump 10, and a cryopump control unit 100 which controls a vacuum exhaust operation and a regeneration operation of the cryopump 10. For example, the cryopump 10 is attached to a vacuum chamber of an ion implantation device, a sputtering device, or the like, and is used so as to increase a vacuum degree inside the vacuum chamber to a level which is required in a desired process. The cryopump control unit 100 may be integrally provided in the cryopump 10, and may be configured of a controller separate from the cryopump 10.

The cryopump 10 includes an intake port 12 for receiving gas. The intake port 12 is an inlet with respect to an internal space 14 of the cryopump 10. Gas to be exhausted enters the internal space 14 of the cryopump 10 through the intake port 12 from the vacuum chamber to which the cryopump 10 is attached.

In addition, hereinafter, for easy understanding of positional relationships between components of the cryopump 10, terms such as an "axial direction" or a "radial direction" may be used. The axial direction indicates a direction intersecting the intake port 12, and the radial direction indicates a direction along the intake port 12. For convenience, a side which is relatively close to the intake port 12 in the axial direction may be referred to as the "top," and a side which is relatively far from the intake port 12 may be referred to as the "bottom." That is, a side which is relatively far from a bottom portion of the cryopump 10 may be referred to as the "top," and a side which is relatively close to the bottom portion of the cryopump 10 may be referred to as the "bottom." A side which is close to the center of the intake port 12 in the radial direction may be referred to as the "inner" and "inside," and a side which is positioned away from a peripheral edge of the intake port 12 may be referred to as the "outer" and "outside." In addition, the above-described expressions are not related to dispositions when the cryopump 10 is attached to the vacuum chamber. For example, the cryopump 10 may be attached to the vacuum chamber in a state where the intake port 12 faces downward in a vertical direction.

The cryopump 10 includes a low temperature cryopanel 18 and a high temperature cryopanel 19. In addition, the cryopump 10 includes a cooling system which cools the high temperature cryopanel 19 and the low temperature cryopanel 18. The cooling system includes a refrigerator 16 and a compressor 36.

For example, the refrigerator 16 is a cryogenic refrigerator such as a Gifford McMahon refrigerator (a so-called GM refrigerator). The refrigerator 16 is a two-stage refrigerator which includes a first stage 20, a second stage 21, a first cylinder 22, a second cylinder 23, a first displacer 24, and a second displacer 25. Accordingly, a high temperature stage of the refrigerator 16 includes the first stage 20, the first cylinder 22, and the first displacer 24. A low temperature stage of the refrigerator 16 includes the second stage 21, the second cylinder 23, and the second displacer 25.

The first cylinder 22 and the second cylinder 23 are connected to each other in series. The first stage 20 is installed in a connection portion between the first cylinder 22 and the second cylinder 23. The second cylinder 23 connects the first stage 20 and the second stage 21. The second stage 21 is installed on the terminal of the second cylinder 23. The first displacer 24 and the second displacer 25 are respectively disposed inside the first cylinder 22 and the second cylinder 23 so as to be movable in a longitudinal direction (right-left direction in FIG. 1) of the refrigerator 16. The first displacer 24 and the second displacer 25 are connected to each other so as to be integrally movable. A first regenerator and a second regenerator (both are not shown) are respectively incorporated into the first displacer 24 and the second displacer 25.

The refrigerator 16 includes a driving mechanism 17 which is provided on the high temperature end of the first cylinder 22. The driving mechanism 17 is connected to the first displacer 24 and the second displacer 25 such that the first displacer 24 and the second displacer 25 can be reciprocated in the inner portions of the first cylinder 22 and the second cylinder 23, respectively. In addition, the driving mechanism 17 includes a flow path switching mechanism which switches a flow path of an operating gas such that supply and discharging of the operating gas are periodically repeated. For example, the flow path switching mechanism includes a valve portion and a driving portion which drives the valve portion. For example, the valve portion includes a rotary valve, and the driving portion includes a motor for rotating the rotary valve. For example, the motor may be an AC motor or a DC motor. In addition, the flow path switching mechanism may be a direct acting type mechanism which is driven by a linear motor.

The refrigerator 16 is connected to the compressor 36 via a high pressure conduit 34 and a low pressure conduit 35. The refrigerator 16 expands a high pressure operating gas (for example, helium) supplied from the compressor 36 in the inner portion of the refrigerator 16, and generates coldness in the first stage 20 and the second stage 21. The compressor 36 recovers the operating gas expanded by the refrigerator 16, recompresses the operating gas, and supplies the operating gas to the refrigerator 16.

Specifically, first, the driving mechanism 17 causes the high pressure conduit 34 and the internal space of the refrigerator 16 to communicate with each other. A high pressure operating gas is supplied from the compressor 36 to the refrigerator 16 through the high pressure conduit 34. If the inner space of the refrigerator 16 is filled with the high pressure operating gas, the driving mechanism 17 switches the flow path such that the internal space of the refrigerator 16 communicates with the low pressure conduit 35. Accordingly, the operating gas is expanded. The expanded operating gas is recovered by the compressor 36. The first displacer 24 and the second displacer 25 respectively reciprocate in the inner portions of the first cylinder 22 and the second cylinder 23 in synchronization with the supply and the discharging of the operating gas. By repeating the thermal cycle, the refrigerator 16 generates coldness in the first stage 20 and the second stage 21.

The refrigerator 16 is configured so as to cool the first stage 20 to a first temperature level and so as to cool the second stage 21 to a second temperature level. The second temperature level is lower than the first temperature level. For example, the first stage 20 is cooled to approximately 65 K to 120 K, and preferably, is cooled to 80 K to 100 K, and the second stage 21 is cooled to approximately 10 K to 20 K.

FIG. 1 shows a section which includes the center axis of the internal space 14 of the cryopump 10 and the center axis of the refrigerator 16. The cryopump 10 shown in FIG. 1 is a so-called horizontal cryopump. In general, a horizontal cryopump is a cryopump in which the refrigerator 16 is disposed so as to intersect (typically, so as to be orthogonal to) the center axis of the internal space 14 of the cryopump 10. Certain embodiments of the invention can be similarly applied to a so-called vertical cryopump. A vertical cryopump is a cryopump in which the refrigerator is disposed along the axial direction of the cryopump.

The low temperature cryopanel 18 is provided in a center portion of the internal space 14 of the cryopump 10. For example, the low temperature cryopanel 18 includes a plurality of panel members 26. For example, each of the panel members 26 has a truncated cone side-surface shape, that is, an umbrella shape. In general, an adsorbent 27 such as activated carbon is provided in each panel member 26. For example, the adsorbent 27 is adsorbed to a rear surface of the panel member 26. In this way, the low temperature cryopanel 18 includes an adsorption region so as to adsorb gas molecules.

The panel member 26 is attached to a panel attachment member 28. The panel attachment member 28 is attached to the second stage 21. In this way, the low temperature cryopanel 18 is thermally coupled to the second stage 21. Accordingly, the low temperature cryopanel 18 is cooled to the second temperature level.

The high temperature cryopanel 19 includes a radiation shield 30 and an inlet cryopanel 32. The high temperature cryopanel 19 is provided outside the low temperature cryopanel 18 so as to surround the low temperature cryopanel 18. The high temperature cryopanel 19 is thermally coupled to the first stage 20, and the high temperature cryopanel 19 is cooled to the first temperature level.

The radiation shield 30 is provided so as to mainly protect the low temperature cryopanel 18 from radiant heat generated from the housing 38 of the cryopump 10. The radiation shield 30 is provided between the housing 38 and the low temperature cryopanel 18, and surrounds the low temperature cryopanel 18. An upper end of the radiation shield 30 in the axial direction is open toward the intake port 12. The radiation shield 30 has a tubular shape (for example, a cylinder) in which the lower end in the axial direction is closed, and is formed in a cup shape. A hole for attaching the refrigerator 16 is provided on a side surface of the radiation shield 30, and the second stage 21 is inserted into the radiation shield 30 from the hole. The first stage 20 is fixed to the outer surface of the radiation shield 30 in the outer circumferential portion of the attachment hole. In this way, the radiation shield 30 is thermally coupled to the first stage 20.

The inlet cryopanel 32 is disposed along the radial direction in the intake port 12. The inlet cryopanel 32 is disposed on a shield opening end 31. The outer circumferential portion of the inlet cryopanel 32 is fixed to the shield opening end 31, and the inlet cryopanel 32 is thermally coupled to the radiation shield 30. The inlet cryopanel 32 is provided so as to be separated from the low temperature cryopanel 18 upward in the axial direction. For example, the inlet cryopanel 32 is formed in a louver structure or a chevron structure. The inlet cryopanel 32 may be formed in a concentrically circular shape which has the center axis of the radiation shield 30 as the center, or may be formed in other shapes such as a lattice shape.

The inlet cryopanel 32 is provided so as to exhaust gas which enters the intake port 12. Gas (for example, water) which is condensed at the temperature of the inlet cryopanel 32 is captured on the surface of the inlet cryopanel 32. In addition, the inlet cryopanel 32 is provided so as to protect the low temperature cryopanel 18 from radiant heat generated from an external heat source (for example, a heat source in the vacuum chamber to which the cryopump 10 is attached) of the cryopump 10. Not only entering of the radiant heat but also entering of gas molecules is limited. The inlet cryopanel 32 occupies a portion of an opening area of the intake port 12 so as to limit the gas flowing into the internal space 14 through the intake port 12 to a desired amount.

The cryopump 10 includes the housing 38. The housing 38 is a vacuum vessel for separating the inside and the outside of the cryopump 10 from each other. The housing 38 is configured so as to maintain an airtight internal space 14 in the cryopump 10. The housing 38 is provided outside the high temperature cryopanel 19, and surrounds the high temperature panel 19. In addition, the housing 38 accommodates the refrigerator 16. That is, the housing 38 is a cryopump vessel which accommodates the high temperature cryopanel 19 and the low temperature cryopanel 18.

The housing 38 is fixed to a portion at an outer environment temperature (for example, a high temperature portion of the refrigerator 16) so as to not come into contact with the high temperature cryopanel 19 and the lower temperature portion of the refrigerator 16. The outer surface of the housing 38 is exposed to the outer environment, and the temperature (for example, approximately room temperature) of the outer surface is higher than the cooled high temperature cryopanel 19.

In addition, the housing 38 includes an intake port flange 56 which extends toward the outside in the radial direction from the opening end of the housing 38. The intake port flange 56 is a flange for attaching the cryopump 10 to the vacuum chamber. A gate valve (not shown) is provided in the opening of the vacuum chamber, and the intake port flange 56 is attached to the gate valve. In this way, the gate valve is positioned above the inlet cryopanel 32 in the axial direction. For example, the gate valve is closed when the cryopump 10 is regenerated, and the gate valve is open when the cryopump 10 exhausts gas in the vacuum chamber.

A vent valve 70, a roughing valve 72, and a purge valve 74 are attached to the housing 38.

For example, the vent valve 70 is provided on a terminal of a discharging line 80 through which a fluid is discharged from the inner portion of the cryopump 10 to the outside environment. By opening the vent valve 70, the flow to the discharging line 80 is allowed, and by closing the vent valve 70, the flow to the discharging line 80 is blocked. The discharged fluid is substantially gas. However, the discharged fluid may be liquid or a mixture of gas and liquid. For example, a liquefied material of gas which is condensed in the cryopump 10 may be mixed into the discharged liquid. By opening the vent valve 70, it is possible to release a positive pressure, which is generated inside the housing 38, to the outside.

The roughing valve 72 is connected to a roughing pump 73. By opening and closing the roughing valve 72, the roughing pump 73 and the cryopump 10 communicate with each other or are disconnected from each other. By opening the roughing valve 72, the roughing pump 73 and the housing 38 communicate with each other, and by closing the roughing valve 72, the roughing pump 73 and the housing 38 are disconnected from each other. By opening the roughing valve 72 and operating the roughing pump 73, it is possible to depressurize the inner portion of the cryopump 10.

The roughing pump 73 is a vacuum pump for evacuating the cryopump 10. The roughing pump 73 is a vacuum pump for supplying a low vacuum region in an operation pressure range of the cryopump 10, that is, a base pressure level which is an operation starting pressure of the cryopump 10 to the cryopump 10. The roughing pump 73 can depressurize the housing 38 from atmospheric pressure to the base pressure level. The base pressure level corresponds to a high vacuum region of the roughing pump 73, and is included in an overlapping portion of the operation pressure ranges of the roughing pump 73 and the cryopump 10. For example, the base pressure level is a range of 1 Pa to 50 Pa (for example, approximately 10 Pa).

Typically, the roughing pump 73 is provided as a vacuum device separately from the cryopump 10, and for example, configures a portion of a vacuum system including the vacuum chamber to which the cryopump 10 is connected. The cryopump 10 is a main pump for the vacuum chamber, and the roughing pump 73 is an auxiliary pump.

The purge valve 74 is connected to a purge gas supply device including a purge gas source 75. By opening or closing the purge valve 74, the purge gas source 75 and the cryopump 10 communicate with each other or are disconnected from each other, and supply of purge gas to the cryopump 10 is controlled. By opening the purge valve 74, a flow of the purge gas from the purge gas source 75 to the housing 38 is allowed. By closing the purge valve 74, a flow of the purge gas from the purge gas source 75 to the housing 38 is blocked. By opening the purge valve 74, the purge gas is introduced from the purge gas source 75 to the housing 38, and it is possible to increase the pressure inside the cryopump 10. The supplied purge gas is discharged from the cryopump 10 through the vent valve 70 or the roughing valve 72.

In the present embodiment, the temperature of the purge gas is controlled to be the room temperature. However, in an embodiment, the purge gas may be gas which is heated to a higher temperature than room temperature, or gas having a lower temperature than room temperature. In the present specification, room temperature is a temperature which is selected from a range of 10° C. to 30° C. or a range of 15° C. to 25° C., and is approximately 20° C., for example. For example, the purge gas is nitrogen gas. The purge gas may be dried gas.

The cryopump 10 includes a first temperature sensor 90 which measures the temperature of the first stage 20, and a second temperature sensor 92 which measures the temperature of the second stage 21. The first temperature sensor 90 is attached to the first stage 20. The second temperature sensor 92 is attached to the second stage 21. The first temperature sensor 90 periodically measures the temperature of the first stage 20, and outputs signals indicating the temperature to the cryopump control unit 100. The first temperature sensor 90 is connected to the cryopump control unit 100 such that the output of the first temperature sensor 90 can be communicated to the cryopump control unit 100. The second temperature sensor 92 is similarly configured. The measured temperature of each of the first temperature sensor 90 and the second temperature sensor 92 may be used in the cryopump control unit 100 as the temperature of each of the high temperature cryopanel 19 and the low temperature cryopanel 18.

In addition, a pressure sensor 94 is provided inside the housing 38. For example, the pressure sensor 94 is provided in the vicinity of the refrigerator 16 outside the high temperature cryopanel 19. The pressure sensor 94 periodically measures the pressure of the housing 38, and outputs signals indicating the measured pressure to the cryopump control unit 100. The pressure sensor 94 is connected to the cryopump control unit 100 such that the output of the pressure sensor 94 can be communicated to the cryopump control unit 100.

The cryopump control unit 100 is configured so as to control the refrigerator 16 such that the refrigerator 16 performs a vacuum exhaust operation and a regeneration operation of the cryopump 10. The cryopump control unit 100 is configured so as to receive the measured results of various sensors including the first temperature sensor 90, the second temperature sensor 92, and the pressure sensor 94. The cryopump control unit 100 calculates a control command which is applied to the refrigerator 16 and various valves, based on the measured results.

For example, in the vacuum exhaust operation, the cryopump control unit 100 controls the refrigerator 16 such that a stage temperature (for example, first stage temperature) follows a target cooling temperature. Typically, the target temperature of the first stage 20 is set to a constant value. For example, the target temperature of the first stage 20 is determined by a specification corresponding to a process which is performed in the vacuum chamber to which the cryopump 10 is attached. In addition, the cryopump control unit 100 is configured so as to control the exhaust from the housing 38 and the supply of the purge gas to the housing 38 such that the regeneration of the cryopump 10 is performed. The cryopump control unit 100 controls the opening and closing of the vent valve 70, the roughing valve 72, and the purge valve 74 during the regeneration.

Hereinafter, an operation of the cryopump 10 having the above-described configuration will be described. When the cryopump 10 is operated, first, the inner portion of the cryopump 10 is roughly pumped to the operation starting pressure (for example, approximately 1 Pa to 10 Pa) through the roughing valve 72 by the roughing pump 73 before the cryopump 10 is operated. Thereafter, the cryopump 10 is operated. According to the control of the cryopump control unit 100, the first stage 20 and the second stage 21 are cooled by the operation of the refrigerator 16, and the high temperature cryopanel 19 and the low temperature cryopanel 18 which are thermally coupled to the first stage 20 and the second stage 21 are also cooled.

The inlet cryopanel 32 cools the gas molecules flying into the inner portion of the cryopump 10 from the vacuum chamber, condenses gas (for example, water or the like) having a sufficiently low vapor pressure on the surface of the inlet cryopanel 32 at the cooling temperature, and exhausts the condensate. The gas, which does not have a sufficiently low vapor pressure at the cooling temperature of the inlet cryopanel 32, passes through the inlet cryopanel 32, and enters the inner portion of the radiation shield 30. In the entering gas molecules, the gas which has a sufficiently low vapor pressure at the cooling temperature of the low temperature cryopanel 18 is condensed on the surface of the low temperature cryopanel 18, and the condensate is exhausted. The gas (for example, hydrogen or the like) which does not have a sufficiently low vapor pressure at the cooling temperature is adsorbed by the absorbent 27 which is attached to the surface of the low temperature cryopanel 18 and is cooled, and is exhausted. In this way, it is possible to reach the vacuum degree of the vacuum chamber to which the cryopump 10 is attached to a desired level.

By continuously performing the exhaust operation, the gas is accumulated in the cryopump 10. In order to discharge the accumulated gas to the outside, regeneration of the cryopump 10 is performed. The cryopump control unit 100 determines whether or not predetermined regeneration start conditions are satisfied, and starts the regeneration when the conditions are satisfied. When the conditions are not satisfied, the cryopump control unit 100 does not start the regeneration, and continues the vacuum exhaust operation. For example, the regeneration start conditions may include a case where a predetermined time has elapsed after the vacuum exhaust operation has started.

Figure 2:
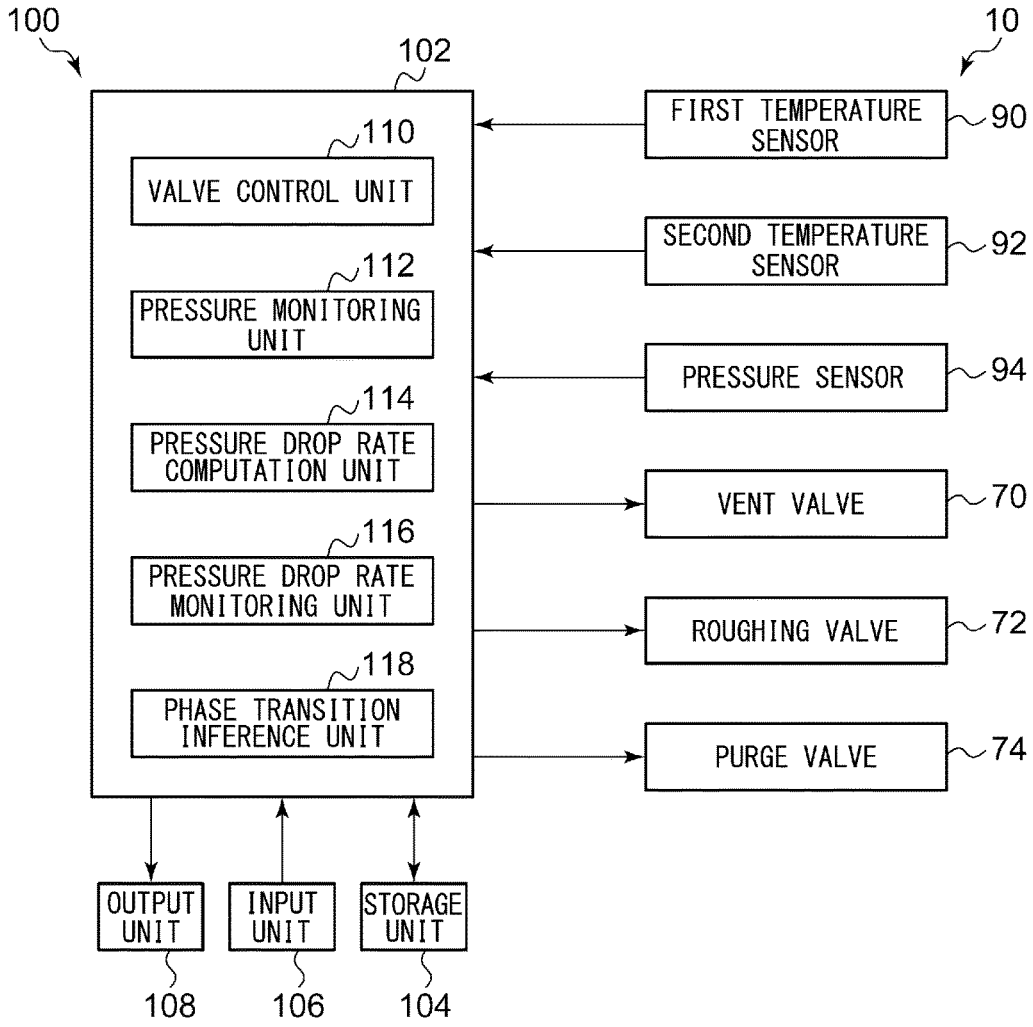
FIG. 2 is a diagram schematically showing a configuration of a cryopump control unit according to an embodiment of the present invention.

FIG. 2 is a diagram schematically showing a configuration of the cryopump control unit 100 according to an embodiment of the present invention. The controller is realized by software, hardware, or a combination thereof. In addition, in FIG. 2, the configuration of a portion of the related cryopump 10 is schematically shown.

The cryopump control unit 100 includes a regeneration control unit 102, a storage unit 104, an input unit 106, and an output unit 108.

The regeneration control unit 102 is configured so as to control the cryopump 10 according to a regeneration sequence including temperature increasing processing, discharging processing, and cool-down processing. For example, the regeneration sequence may provide full regeneration of the cryopump 10. In the full regeneration, all cryopanels including the high temperature cryopanel 19 and the low temperature cryopanel 18 are regenerated. In addition, the regeneration control unit 102 may control the cryopump 10 according to a regeneration sequence indicating partial regeneration.

The storage unit 104 is configured so as to store information related to the control of the cryopump 10. The input unit 106 is configured so as to receive an input from a user or other devices. For example, the input unit 106 includes input means such as a mouse or a keyboard for receiving an input from a user and/or communication means for communicating with other devices. The output unit 108 is configured so as to output information related to the control of the cryopump 10, and includes output means such as a display or a printer. Each of the storage unit 104, the input unit 106, and the output unit 108 is connected to the regeneration control unit 102 so as to communicate with the regeneration control unit 102.

The regeneration control unit 102 includes a valve control unit 110, a pressure monitoring unit 112, a pressure drop rate computation unit 114, a pressure drop rate monitoring unit 116, and a phase transition inference unit 118. The valve control unit 110 is configured so as to open and close the vent valve 70, the roughing valve 72, and/or the purge valve 74 according to the regeneration sequence. The valve control unit 110 determines the opening timing and the closing timing of the vent valve 70, the roughing valve 72, and/or the purge valve 74 based on the input. The pressure monitoring unit 112, the pressure drop rate computation unit 114, the pressure drop rate monitoring unit 116, and the phase transition inference unit 118 will be described below.

The temperature increasing processing is a first process of regeneration in which the low temperature cryopanel 18 and/or the high temperature cryopanel 19 of the cryopump 10 is heated from a cryogenic temperature Tb to a regeneration temperature Ta. The cryogenic temperature Tb is a standard operation temperature of the cryopump 10, and includes an operation temperature Tb1 of the high temperature cryopanel 19 and an operation temperature Tb2 of the low temperature cryopanel 18. As described above, for example, the operation temperature Tb1 of the high temperature cryopanel 19 is selected from the range of 65 K to 120 K, and the operation temperature Tb2 of the low temperature cryopanel 18 is selected from the range of 10 K to 20 K.

The regeneration temperature Ta is a cryopanel target temperature in the temperature increasing processing, and is the melting point of the condensate accumulated in the cryopump 10 or higher. For example, the condensate includes water, and in this case, the regeneration temperature Ta is 273 K or higher. The regeneration temperature Ta may be room temperature or higher. The regeneration temperature Ta may be an operating temperature limit of the cryopump 10 or lower. For example, the operating temperature limit of the cryopump 10 may be approximately 320 K to 340 K (for example, approximately 330 K).

The regeneration control unit 102 is configured so as to control the cryopump 10 such that the temperature of the low temperature cryopanel 18 and/or the high temperature cryopanel 19 is adjusted to the target temperature which is determined by the regeneration sequence. The regeneration control unit 102 uses the measured temperature of the first temperature sensor 90 and/or the second temperature sensor 92 as the temperature of the low temperature cryopanel 18 and/or the high temperature cryopanel 19.

The regeneration control unit 102 controls at least one heat source provided in the cryopump 10 such that the temperature of the low temperature cryopanel 18 and/or the high temperature cryopanel 19 is controlled to be the target temperature. For example, the regeneration control unit 102 may open the purge valve 74 so as to supply the purge gas to the housing 38 in the temperature increasing processing. In addition, the regeneration control unit 102 may close the purge valve 74 so as to stop the supply of the purge gas to the housing 38. In this way, in the temperature increasing processing, the purge gas may be used as a first heat source for heating the low temperature cryopanel 18 and/or the high temperature cryopanel 19.

In order to heat the low temperature cryopanel 18 and/the high temperature cryopanel 19, a second heat source different from the purge gas may be used. For example, the regeneration control unit 102 may control a temperature increasing operation of the refrigerator 16. The refrigerator 16 is configured such that adiabatic compression is generated in the operating gas when the driving mechanism 17 is operated in a direction opposite to the cooling operation. The refrigerator 16 heats the first stage 20 and the second stage 21 by the obtained compression heat. The heating is referred to as a reversal heating of the refrigerator 16. Each of the high temperature cryopanel 19 and the low temperature cryopanel 18 is heated by the first stage 20 and the second stage 21 serving as the heat source. Alternatively, a heater which is installed in the refrigerator 16 may be used as the heat source. In this case, the regeneration control unit 102 can control the heater independently of the operation of the refrigerator 16.

In the temperature increasing processing, one of the first and second heat sources may be singly used, or both may be simultaneously used. In the discharging processing, similarly, one of the first and second heat sources may be singly used, or both may be simultaneously used. The regeneration control unit 102 may switch between the first heat source and the second heat source, or may use the first heat source and the second heat source together so as to control the temperature of the low temperature cryopanel 18 and/or the high temperature cryopanel 19 to be the target temperature.

The regeneration control unit 102 determines whether or not the measured value of the cryopanel temperature reaches the target temperature. The regeneration control unit 102 continues the temperature increase until the temperature reaches the target temperature, and when the temperature reaches the target temperature, the regeneration control unit 102 ends the temperature increasing processing. The regeneration control unit 102 may continue the temperature increasing processing during a predetermined period after the temperature reaches the target temperature. In this case, the supply of the purge gas may be continued. When the temperature increasing processing ends, the regeneration control unit 102 starts the discharging processing.

In the temperature increasing processing, the condensate and/or the adsorbed material on the low temperature cryopanel 18 and/or the high temperature cryopanel 19 may be discharged from the cryopump 10. The valve control unit 110 opens the vent valve 70 and/or the roughing valve 72 so as to discharge the condensate and/or the adsorbed material from the housing 38, and may close the valves in a timely manner after the opening.

The discharging processing is a second process of the regeneration which discharges the condensate and/or the adsorbed material from the cryopump 10. In the cryopanel temperature Tb, the condensate and/or the adsorbed material is positioned on the low temperature cryopanel 18 and/or the high temperature cryopanel 19. In a process in which the condensate and/or the adsorbed material is/are heated from the cryogenic temperature Tb to the regeneration temperature Ta, the condensate and/or the adsorbed material is melted and finally vaporized. In the discharging processing, the regeneration control unit 102 continues the temperature control of the low temperature cryopanel 18 and/or the high temperature cryopanel 19 such that the temperature reaches the regeneration temperature Ta or other target temperatures.

The gas re-vaporized from the cryopanel surface is discharged to the outside of the cryopump 10. For example, the re-vaporized gas is discharged to the outside through the discharging line 80 or using the roughing pump 73. The re-vaporized gas is discharged from the cryopump 10 along with the purge gas which has been introduced if necessary.

The discharging processing may include rough and purge processing. The rough and purge processing is a process in which the rough pumping of the housing 38 and the supply of the purge gas are alternately performed. In the rough and purge processing, a combination of the rough pumping and the purge is performed once or a plurality of times. Typically, in the rough and purge processing, the regeneration control unit 102 selectively performs the rough pumping and the purge. That is, when the rough pumping (or the purge) is performed, the purge (or the rough pumping) stops.

Alternatively, in the rough and purge processing, while one of the rough pumping and the purge is continuously performed, the other of the rough pumping and the purge may be intermittently performed. This is included in the case where the rough pumping and the supply of the purge gas are alternately performed. The starting and the ending of the rough pumping and the purge may be performed based on the pressure and/or the pressure drop rate of the housing 38, or may be performed based on an elapse time.

The regeneration control unit 102 continues the discharging processing until discharging completion conditions are satisfied. The discharging completion conditions are obtained based on the pressure inside the cryopump 10, for example, the measured pressure of the pressure sensor 94. For example, the regeneration control unit 102 may determine that there is condensate remaining in the cryopump 10 while the measured pressure in the housing 38 exceeds a predetermined threshold value. Accordingly, the cryopump 10 continues the discharging processing. The regeneration control unit 102 determines that the discharging of the condensate is completed when the measured pressure inside the housing 38 is lower than the threshold value. In this case, the regeneration control unit 102 ends the discharging processing and starts the cool-down processing.

The regeneration control unit 102 may perform a so-called built-up test. In the built-up test of the cryopump regeneration, it is determined that the condensate is being discharged from the cryopump 10 when a pressure rise gradient from the pressure at the determination starting point does not exceed a threshold value. This is referred to as a Rate-of-Rise (RoR) method. Accordingly, the regeneration control unit 102 may end the discharging processing when an amount of pressure increase per unit time at the base pressure level is lower than the threshold value.

The pressure monitoring unit 112 is configured so as to monitor the pressure in the cryopump 10 (that is, in the housing 38) using the measured pressure of the pressure sensor 94. The pressure monitoring unit 112 may determine whether or not the pressure in the cryopump 10 is within a pressure region. The pressure region may be a pressure region having a higher pressure than the operation starting pressure of the cryopump. The pressure monitoring unit 112 may compare the pressure in the cryopump 10 and the pressure threshold value so as to determine whether or not the pressure is higher than the threshold value. The pressure threshold value may be the operation starting pressure of the cryopump or higher. The pressure threshold value may be higher than the base pressure level, and for example, may be selected from a range of 50 Pa to 500 Pa, and preferably, a range of 100 Pa to 200 Pa. The pressure region may be referred to as a semi-base pressure level. Accordingly, the pressure monitoring unit 112 may determine whether or not the pressure in the cryopump 10 is at the base pressure level, or may determine whether or not the pressure in the cryopump 10 is at the semi-base pressure level. The pressure monitoring unit 112 may store the pressure in the cryopump 10 and/or the determined results in the storage unit 104, and/or may output the pressure in the cryopump 10 and/or the determined results to the output unit 108.

The pressure drop rate computation unit 114 is configured to compute the pressure drop rate in the cryopump 10 during the rough pumping of the cryopump 10. The pressure drop rate computation unit 114 periodically calculates the pressure drop rate from the measured pressure of the pressure sensor 94 while the roughing valve 72 is open. The pressure drop rate is an amount of pressure decrease per unit time generated by the rough pumping. The pressure drop rate computation unit 114 may calculate a logarithm (for example, common logarithm) of the pressure drop rate from the measured pressure of the pressure sensor 94. The pressure drop rate computation unit 114 outputs the calculated pressure drop rate to the pressure drop rate monitoring unit 116. The pressure drop rate computation unit 114 may store the pressure drop rate in the storage unit 104 and/or may output the pressure drop rate to the output unit 108.

The pressure drop rate monitoring unit 116 is configured so as to monitor the pressure drop rate during the rough pumping of the cryopump 10. The pressure drop rate monitoring unit 116 detects a reduction in the pressure drop rate during a given single cycle of rough pumping. The pressure drop rate monitoring unit 116 may compare the pressure drop rate and a pressure drop rate threshold value so as to determine whether or not the pressure drop rate is higher than the threshold value. The pressure drop rate threshold value may be the pressure drop rate at the time of starting the single rough-pumping cycle, or may be a value which is slightly less than this pressure drop rate.

The pressure drop rate monitoring unit 116 detects the reduction in the pressure drop rate when the pressure drop rate is lower than the pressure drop rate threshold value. For example, the pressure drop rate monitoring unit 116 may detect the reduction in the pressure drop rate when the pressure drop rate during a given single cycle of rough pumping is initially lower than the pressure drop rate threshold value. Alternatively, the pressure drop rate monitoring unit 116 may detect the reduction in the pressure drop rate when the pressure drop rate is lower than the pressure drop rate threshold value during a predetermined time. The pressure drop rate monitoring unit 116 outputs the detected results to the phase transition inference unit 118. The pressure drop rate monitoring unit 116 may store the detected result in the storage unit 104 and/or may output the detected results to the output unit 108. The pressure drop rate monitoring unit 116 may detect the reduction in the pressure drop rate during the rough pumping only when it is determined that the measured pressure of the pressure sensor 94 is within a predetermined pressure region by the pressure monitoring unit 112.

The pressure drop rate monitoring unit 116 may detect transition from a first pressure drop rate region to a second pressure drop rate region during a given single cycle of rough pumping. The first pressure drop rate region may be a range of the pressure drop rate including the pressure drop rate at the time of starting the single rough-pumping cycle. The second drop rate region may have a range of the pressure drop rate which is smaller than the first pressure drop rate region. The pressure drop rate monitoring unit 116 may detect the transition of the pressure drop rate as the reduction in the pressure drop rate.

The phase transition inference unit 118 is configured so as to infer a phase transition of the condensate to be discharged from the cryopump 10. When the reduction in the pressure drop rate is detected during the rough pumping of the cryopump 10, the phase transition inference unit 118 estimates a change (that is, freezing of the condensate) from a liquid phase of the condensate to a solid phase thereof. The phase transition inference unit 118 may store the estimated results in the storage unit 104 and/or may output the estimated results to the output unit 108.

The valve control unit 110 temporarily closes the roughing valve 72 and/or temporarily opens the purge valve 74 in response to the detected reduction in the pressure drop rate. The valve control unit 110 may temporarily close the roughing valve 72 and may temporarily open the purge valve 74. When it is determined that the measured pressure of the pressure sensor 94 is within the predetermined pressure region by the pressure monitoring unit 112, the valve control unit 110 temporarily closes the roughing valve 72 and/or may temporarily open the purge valve 74 in response to the detected reduction in the pressure drop rate.

The storage unit 104 stores regeneration parameters for defining the regeneration sequence. The regeneration parameters are experimentally or empirically determined in advance, and are input to the input unit 106. The regeneration parameters include the cryopanel target temperatures, the discharging completion conditions, the pressure threshold value, and a pressure change rate threshold value. The cryopanel target temperature includes the regeneration temperature Ta and the cryopanel temperature Tb. Each of the regeneration temperature Ta and the cryopanel temperature Tb may be set to a single temperature or a temperature region.

The cool-down processing is a final process of the regeneration in which the cryopump 10 is re-cooled to the cryogenic temperature Tb. The cryogenic temperature Tb is the cryopanel target temperature in the cool-down processing. When the discharging completion conditions are satisfied, the discharging processing is completed, and the cool-down processing starts. The cooling operation of the refrigerator 16 starts. The regeneration control unit 102 continues the cool-down processing such that the target temperature is reached, and when the temperature reaches the target temperature, the regeneration control unit 102 ends the cool-down processing. In this way, the regeneration processing is completed. The vacuum exhaust operation of the cryopump 10 is restarted. The regeneration control unit 102 may be configured so as to perform a temperature control operation of the refrigerator 16 in which the temperature of the low temperature cryopanel 18 or the high temperature cryopanel 19 is maintained to the target temperature in the vacuum exhaust operation.

Figure 3:
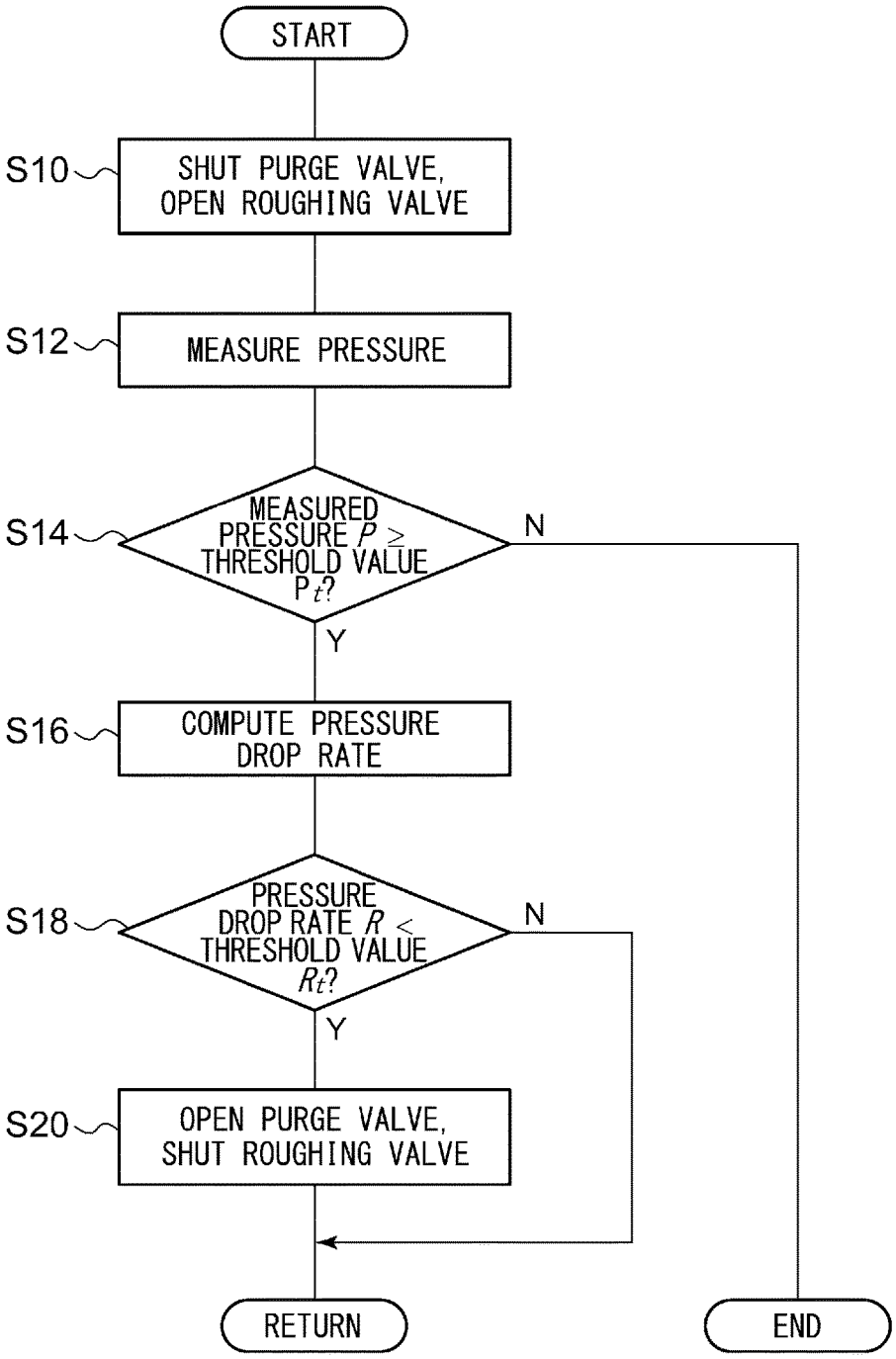
FIG. 3 is a flowchart showing a main portion of a cryopump regeneration method according to an embodiment of the present invention.
Figure 4:
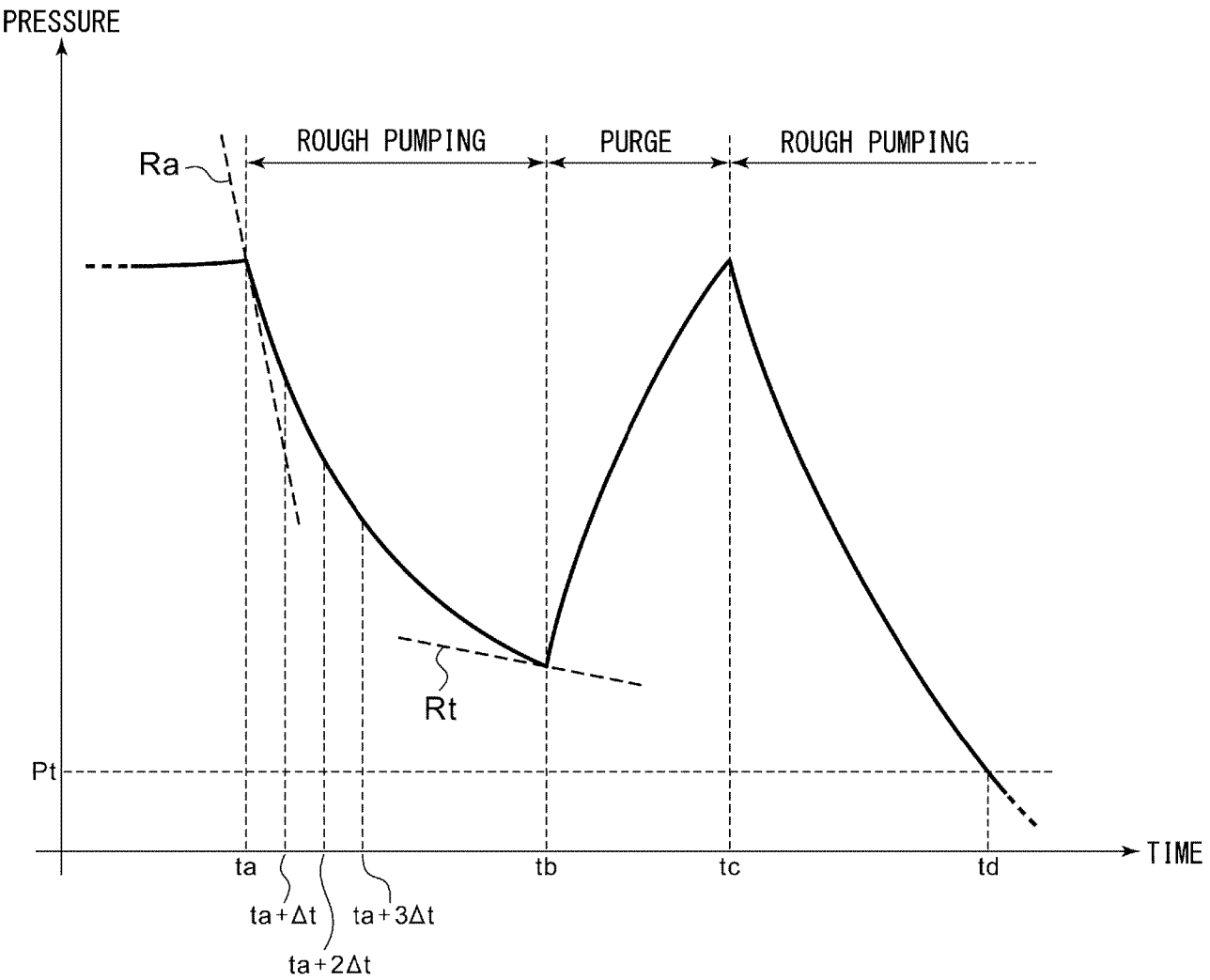
FIG. 4 is a diagram schematically exemplifying a pressure change in a cryopump according to an embodiment of the present invention.

FIG. 3 is a flowchart showing a main portion of a cryopump regeneration method according to an embodiment of the present invention. FIG. 4 is a diagram schematically exemplifying a pressure change in the cryopump 10 according to an embodiment of the present invention. FIGS. 3 and 4 show the discharging processing during full regeneration. In FIG. 4, a vertical axis indicates pressure, and a horizontal axis indicates time.

As described above, the regeneration control unit 102 performs the discharging processing subsequently to the temperature increasing processing. The valve control unit 110 detects the completion of the temperature increasing processing, closes the purge valve 74, and opens the roughing valve 72 (S10). In this way, the rough pumping of the housing 38 starts (time to in FIG. 4). In addition, the vent valve 70 is closed in the following processing.

The pressure monitoring unit 112 obtains a measured pressure P of the pressure sensor 94 during the rough pumping (S12). The pressure monitoring unit 112 determines whether or not the measured pressure P is equal to or higher than a pressure threshold value $P_t$ (S14). The pressure threshold value $P_t$ is selected from the base pressure level or the semi-base pressure level.

When the measured pressure P is equal to or higher than the pressure threshold value $P_t$ (Y in S14), the pressure drop rate computation unit 114 calculates a pressure drop rate R from the measured pressure P of the pressure sensor 94 (S16). The pressure drop rate monitoring unit 116 may determine the pressure drop rate threshold value $R_t$ for each rough pumping. For example, the pressure drop rate monitoring unit 116 may calculate the pressure drop rate threshold value $R_t$ based on an initial pressure drop rate Ra which is calculated immediately after the starting of the rough pumping. The initial pressure drop rate Ra is exemplified in FIG. 4. Alternatively, the pressure drop rate monitoring unit 116 may use the predetermined pressure drop rate threshold value $R_t$.

The pressure drop rate monitoring unit 116 determines whether or not the pressure drop rate R is lower than the pressure drop rate threshold value $R_t$ (S18). When the pressure drop rate R is equal to or more than the pressure drop rate threshold value $R_t$ (N in S18), the valve control unit 110 continues the rough pumping of the housing 38 (S10). The monitoring of the measured pressure P and the pressure drop rate R is repeated. As shown in FIG. 4, at time ta+Δt, ta+2Δt, ta+3Δt, . . . , the measured pressure P and the pressure drop rate R are periodically monitored.

Meanwhile, when the pressure drop rate R is lower than the pressure drop rate threshold value $R_t$ (Y in S18), the valve control unit 110 closes the roughing valve 72 and opens the purge valve 74 (S20). At time tb shown in FIG. 4, the pressure drop rate R is smaller than the pressure drop rate threshold value $R_t$. In this way, the rough pumping ends and the purge starts.

The valve control unit 110 ends the purge when the measured pressure P increases to a predetermined pressure (for example, atmospheric pressure) or after a predetermined time elapses after the starting of the purge (time tc in FIG. 4). That is, the valve control unit 110 closes the purge valve 74 again and opens the roughing valve 72 again (S10). In this way, the monitoring of the measured pressure P and the pressure drop rate R is repeated again. Accordingly, the regeneration control unit 102 performs the rough and purge processing while monitoring the measured pressure P and the pressure drop rate R.

When the measured pressure P is lower than the pressure threshold value $P_t$ (N in S14), the regeneration control unit 102 ends the rough and purge processing (time td in FIG. 4). In this case, the regeneration control unit 102 may determine whether or not the discharging completion conditions are satisfied subsequently to the ending of the rough and purge processing. Alternatively, the regeneration control unit 102 may immediately end the discharging processing and may start the cool-down processing.

In the rough and purge processing, there is an advantage that vaporization of water is promoted in the rough pumping. This is because a large amount of water is vaporized in a depressurized environment. However, since evaporation heat cools water, at least a portion of the water is frozen. Accordingly, the evaporation heat decreases. Therefore, the purge gas is introduced. Ice is heated by the purge gas, and is returned to water. In this way, by repeating the rough pumping and the purge, water is discharged from the cryopump 10.

Therefore, in order to effectively discharge water, it is preferable to prevent refreezing. Accordingly, for example, it is preferable to start the purge at the timing when water is changed to ice. However, this is difficult in a typical regeneration sequence. There is no method by which the timing of the refreezing may be ascertained. The timing of the refreezing cannot be detected by simply monitoring the pressure. The reason for this is because the pressure value generated by the refreezing changes significantly due to various factors such as an amount of water accumulated in the cryopump 10 or exhaust capability of the roughing pump 73.

Meanwhile, according to the present embodiment, the pressure drop rate R is monitored. The present inventors found that the freezing of the condensate due to the evaporation heat generated a reduction in the pressure drop rate R. As shown in FIG. 4, compared to the initial pressure drop rate Ra when the rough pumping starts, the pressure drop rate R during the rough pumping gradually decreases. Particularly, when the pressure is plotted on a logarithmic graph, a discontinuity is obviously shown in a pressure profile. By detecting the transition of the pressure drop rate R, it is possible to ascertain the refreezing time of the condensate.

Therefore, according to the present embodiment, it is possible to estimate occurrence of the phase transition from the liquid phase of the condensate to the solid phase thereof. Unlike with pressure monitoring, it is possible to provide a robust estimation method of the phase transition timing.

In addition, the regeneration control unit 102 can use the estimated timing of the phase transition as a trigger which performs a next event in the regeneration sequence. For example, as described above, the regeneration control unit 102 may stop the rough pumping with the detected refreezing timing as the trigger. In addition, the regeneration control unit 102 may start the purge with the detected refreezing timing as the trigger. Since the rough pumping transitions to purging without the refreezing, it is possible to effectively vaporize the condensate. Accordingly, it is possible to shorten the regeneration time.

Hereinbefore, the embodiments of the invention have been described. The present invention is not limited to the above-described embodiments, and a person skilled in the art understands that various design changes may be performed, various modification examples may be performed, and the modification examples are also included in the scope of the present invention.

The regeneration control unit 102 may temporarily close the roughing valve 72 in response to the detected reduction in the pressure drop rate, and may keep the purge valve 74 continuously closed. In this case, the regeneration control unit 102 may temporarily close the roughing valve 72, and, in order to increase heat entering from other heat sources (for example, the refrigerator 16 and/or a heater, or the like) to the cryopanel, the regeneration control unit 102 may control the heat sources. Alternatively, the regeneration control unit 102 may temporarily close the roughing valve 72 may simply. Accordingly, the temperature of the cryopanel may naturally increase. Therefore, the purge valve 74 and the purge gas source need not be provided in the cryopump 10.

The regeneration control unit 102 may temporarily open the purge valve 74 in response to the detected reduction in the pressure drop rate, and may control other heat sources (for example, the refrigerator 16 and/or a heater, or the like). In this way, the cryopanel may be heated by the plurality of heat sources.

When an inflow amount of the gas through the purge valve 74 is larger than an outflow amount of the gas through the roughing valve 72, the regeneration control unit 102 may temporarily open the purge valve 74 in response to the detected reduction in the pressure drop rate and may continuously open the roughing valve 72.

What is claimed is:

1. A cryopump comprising:

a cryopanel;

a cryopump container housing the cryopanel;

a pressure sensor that measures pressure inside the cryopump container during a rough-and-purge process;

a roughing valve provided to the cryopump container and configured to connect the cryopump with, and disconnect the cryopump from, a roughing pump, for rough-pumping of the cryopump container;

a data storage medium configured to store a semi-base pressure for the cryopump, the semi-base pressure being higher than a rough-pumping base pressure of the cryopump, and to store a pressure-drop rate threshold value as a threshold for a pressure-drop rate being amount of decrease in cryopump-pressure per unit time as the cryopump container is pumped down by the roughing pump;

a purge valve provided to the cryopump container and configured to connect the cryopump with, and disconnect the cryopump from, a purge gas source;

a microprocessor communicably connected to the pressure sensor, the roughing valve, the data storage medium, and the purge valve, the microprocessor therein executing cryopump control software to operate as a regeneration controller configured to carry out the rough-and-purge process by controlling the roughing valve's connecting the cryopump with, and disconnecting the cryopump from, the roughing pump to perform rough pumping of the cryopump container, and in alternation therewith controlling the purge valve's connecting the cryopump with, and disconnecting the cryopump from, the purge gas source to supply purge gas into the cryopump container, during the rough-and-purge process, compare the pressure measured by the pressure sensor with the semi-base pressure, and terminate the rough-and-purge process when the pressure measured by the pressure sensor reaches the semi-base pressure; and a pressure-drop rate monitor configured to calculate the pressure-drop rate, based on the pressure measured by the pressure sensor, compare the calculated pressure-drop rate with the pressure-drop rate threshold value, and terminate the rough pumping when the pressure-drop rate is lower than the pressure-drop rate threshold value, regardless of whether the pressure measured by the pressure sensor is higher than the semi-base pressure.

2. The cryopump according to claim 1, wherein the semi-base pressure is in a range of 50 Pa to 500 Pa and the base pressure is in a range of 1 Pa to 50 Pa.

3. The cryopump according to claim 1, wherein the semi-base pressure is in a range of 100 Pa to 200 Pa and the base pressure is in a range of 1 Pa to 50 Pa.

4. The cryopump according to claim 1, wherein the regeneration controller is further configured to start the supply of the purge gas when the pressure-drop rate is lower than the pressure-drop rate threshold value, regardless of whether the pressure measured by the pressure sensor is higher than the semi-base pressure.

5. The cryopump according to claim 1, wherein the regeneration controller is configured to terminate the rough-and-purge process when the pressure measured by the pressure sensor reaches the base pressure of the cryopump.

6. The cryopump according to claim 1, wherein the regeneration controller is configured to, subsequent to termination of the rough-and-purge process, determine whether condensate of water remains in the cryopump container, according to whether the pressure measured by the pressure sensor exceeds a predetermined threshold value.

7. The cryopump according to claim 6, wherein:

the storage is configured to store the base pressure; and the regeneration controller is configured to, subsequent to determination that no condensate of water remains in the cryopump container, compare the pressure measured by the pressure sensor to the base pressure, and start a cool-down process of cooling down the cryopump when the pressure measured by the pressure sensor reaches the base pressure, by re-cooling the cryopanel from a regeneration temperature higher than 273 K to a cryogenic temperature.

8. A method of regenerating the cryopump of claim 1, the method comprising:

measuring, with the pressure sensor, pressure inside the cryopump during the rough-and-purge process;

terminating with the regeneration controller, the rough-and-purge process when the pressure measured by the pressure sensor reaches the semi-base pressure; and terminating, with the regeneration controller, the rough pumping by the roughing pump when the pressure-drop rate is lower than the pressure-drop rate threshold value, regardless of whether the pressure measured by the pressure sensor is higher than the semi-base pressure.

* * * * *